US005145442A

United States Patent [19]

Zan

[11] Patent Number: 5,145,442

[45] Date of Patent: Sep. 8, 1992

[54] MULTI-PURPOSE SOLAR ENERGY OPERATED TOY VEHICLE

[76] Inventor: Ja D. Zan, 5Fl., No. 190, Sec. 2, Kee Lung Rd., Taipei, Taiwan

[21] Appl. No.: 703,754

[22] Filed: May 21, 1991

[51] Int. Cl.[5] ..... A63H 23/04; A63H 17/00

[52] U.S. Cl. ..... 446/163; 446/175; 446/462

[58] Field of Search ..... 446/175, 165, 164, 462, 446/484, 457, 163

[56] References Cited

U.S. PATENT DOCUMENTS 2,838,876 6/1958 Smith, Jr. ..... 446/175 X

FOREIGN PATENT DOCUMENTS 203505 9/1955 Australia ..... 446/165

841259 6/1952 Fed. Rep. of Germany ..... 446/175

*Primary Examiner*—Mickey Yu

*Attorney, Agent, or Firm*—Bacon & Thomas

[57] ABSTRACT

A multi-purpose solar energy operated toy vehicle generally has a plate resembling a ship to be placed on a ship body, while a pair of paddles are connected to the ship body with a motor. A solar cells panel is installed to provide electrical energy by way of photoelectric effect, so that a battery disposed in a housing on the plate can be electrically charged and the motor can be driven to move the vehicle. A pair of front wheels can be rotatably attached on the front portion of the ship body and a pair of rear wheels can replace the paddles to allow the vehicle to run on the ground.

10 Claims, 3 Drawing Sheets

MULTI-PURPOSE SOLAR ENERGY OPERATED TOY VEHICLE

BACKGROUND OF THE INVENTION

The present invention is related to a multi-purpose solar energy operated vehicle, particularly to the type having a body convertable to either a toy ship or car, in which a solar cells panel is installed as an energy source to drive the vehicle.

While solar energy, in contrast to the conventional energy like crude oil, has advantages of being clean, safe, and cheap in certain areas, it has bright future as it merited. However, as people taking this energy as granted, it is the main concern that one can effectively utilize this precious energy.

It has conventionally proposed and commercialized that items like calculators, radios, house hold heating and lighting, or even large-scale solar energy power generator, are designed and manufactured which are directed to one single use with limited purpose.

SUMMARY OF THE INVENTION

The present invention provides a multi-purpose solar energy operated vehicle, which utilizes a solar cells panel to convert solar energy into electric energy by way of photo-electric effect to drive a vehicle through an electrical motor and its associated transmission, and to charge battery for later use. The vehicle has the construction which is suitable to be operated on the ground or water, while the battery, as it is known have various applications.

Therefore, it is an object of the present invention to provide a multi purpose solar energy operated toy vehicle which is suitable to be operated either on land or water.

It is still an object of the present invention to provide a multi-purpose solar energy operated vehicle which can be used as a battery charger.

Other objectives and advantages will be readily apparent as the invention becomes better understood by reference to the following description when considered with the accompanying drawings.

DETAILED DESCRIPTION OF THE PREFERRED EMBODIMENTS

Figure 1:
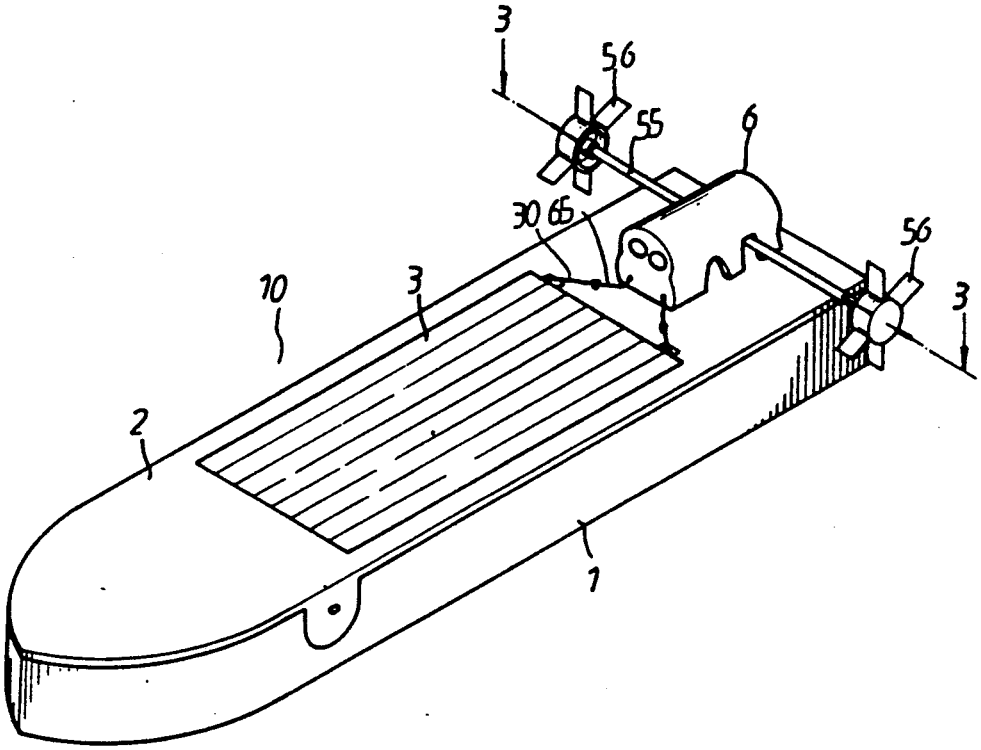
FIG. 1 is a perspective view showing a solar energy operated toy vehicle resembling a boat according to one embodiment of the present invention.

FIG. 1 shows a multi-purpose solar energy operated toy vehicle 10, which generally comprises a body 1 resembling a ship, whereas the shape shown in figures is not intended to the limited one. The ship body 1 is typically made of plastics or any other suitable materials, such as woods or synthetic resin, which are floatable on water, and being light weight to reduce energy consumption and cheap to manufacture.

Figure 2:
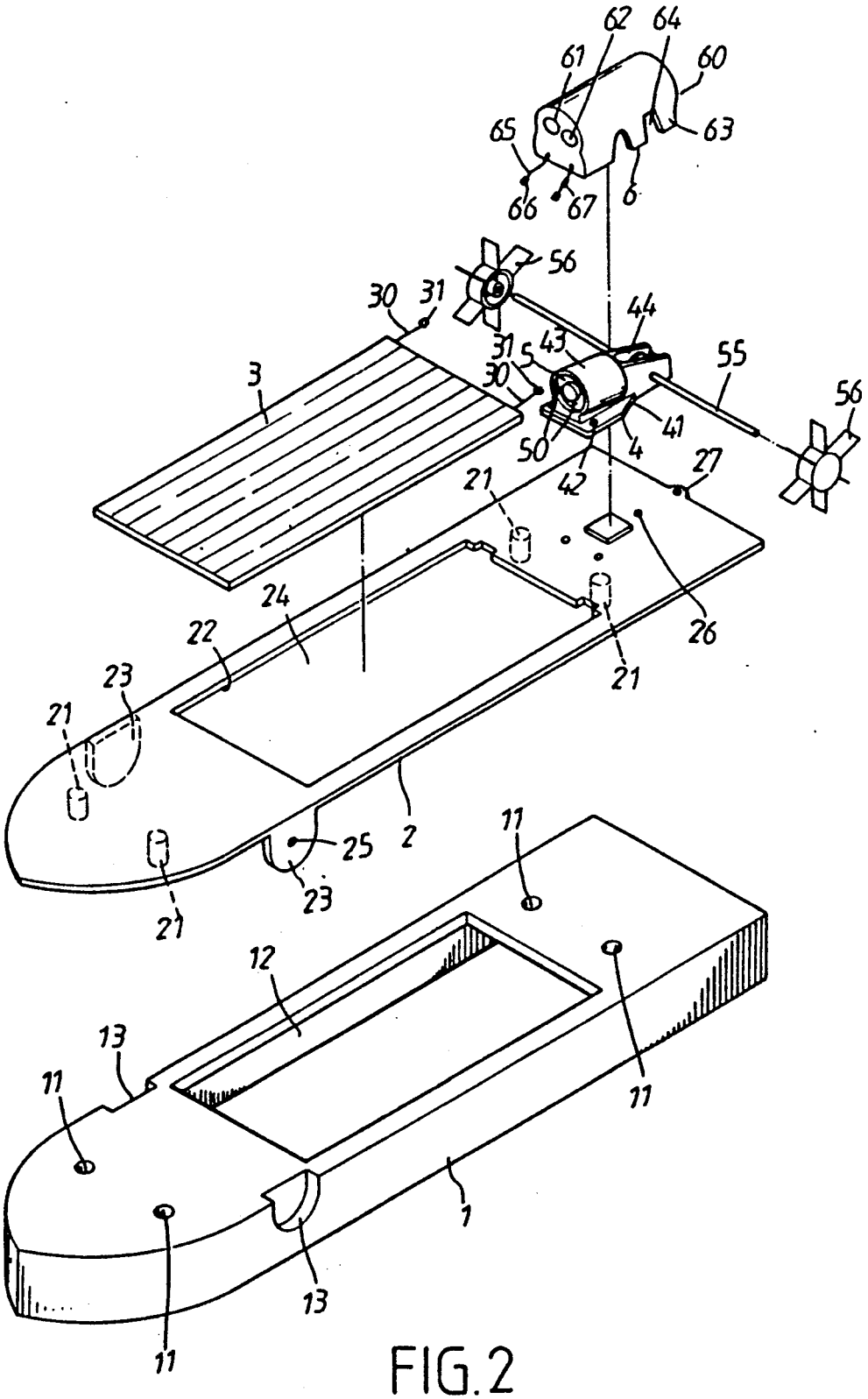
FIG. 2 is a perspective view showing the assembly thereof.

Considering FIG. 2, the body 1 has a plurality of apertures 11 at substantial corners thereon provided to snapfit with respective short projections 21 of a plate 2, so that the plate 2 can be secured to the body 1. The body 1 further has an opening 12 defined on the top to interengage with an extending rib 22 of like shape, whereas in the figure, the opening is defined as a rectangular cutting portion, while the extending rib being a substantial rectangular continuous short wall projecting downwardly to be fitted into the rectangular opening. Provided on both longitudinal sides of the body are a pair of recesses 13, in which a pair of wing plates 23 are inserted in a way that the wing plates can resiliently clamp on the body to ensure the attachment between the body and the plate.

The plate 2 has the shape similar to the body looking from the top, which is typically made by plastic mold injection, having the integrally formed short projections 21 inserting into the respective apertures 11 shown particularly in FIG. 1.

Defined on the plate is an opening 24, which receives a solar cells panel 3 and further snaps into the opening 12 of the body 1 by means of the extending rib 22 integrally formed thereon. In addition to the holding or clamping forces provided by the wing plates 23, each wing plate has a through hole 25 to substantially receive a shaft in corporated with a pair of wheels, so as to convert the vehicle into a toy car. This will be explained in details shortly.

The base which is adapted to support a motor 5 is generally designated by numeral 4 and is attached to the plate 2 by means of three screws 26 substantially arranged into a triangle shape to obtain stable attachment, which is depicted in FIG. 2. The base 4 is plastic injection molded, and has apertures 42 on a bottom plate 41 thereof to receive the respective screws 26. In such manner, the base 4 can be securely attached to the plate 2.

Further referring to FIG. 2, the base 4 has a portion 43 defining a recess for assembling the motor 5, which recess has a periphery slightly smaller than that of the motor, so that the motor can be in tight-fitting relationship therewith. A transmiss box 44 is positioned at the end edge of the portion 43, such that the output shaft 51 of the motor 5 may extend into the transmission box 44.

Figure 3:
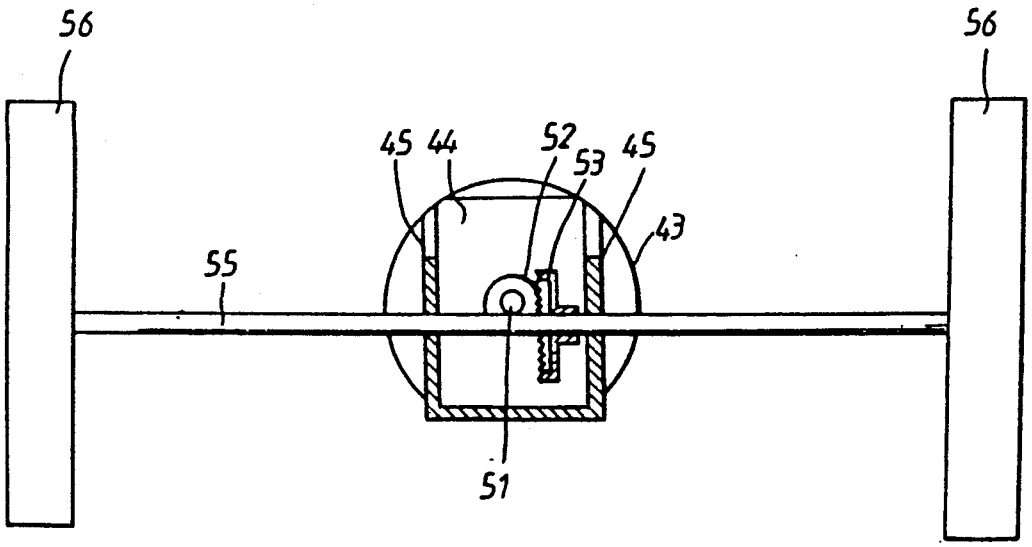
FIG. 3 is a cross-sectional view taken along line 3—3 of FIG. 1 showing the transmission thereof.

The transmission box 44 is shown in FIG. 3, in which there is a pinion gear 52 mounted on the output shaft 51 meshing with a larger ratchet gear 53 fixedly secured to a driven shaft 55. It is noted that the driven shaft 55 is at a right angle with respect to output shaft 57 to convert the motor torque into a driven forces, and it has length longer than the width of the body 1 and plate 2 to receive paddles 56 at both ends. It is also apparent that the pinion gear and ratchet gear can be replaced by a pair of bevel gears to achieve the same purpose.

Noting specially FIG. 1 and 2, there is shown the connection of solar cells panel 3 and motor 5, in which the solar cells panel 3 has inputting conductive wires 30 provided with terminals 31 to electrically connect to inputting terminals 50 of the motor 5. By way of photoelectric effect, the solar cells panel can provide electric energy to drive the motor 5, through which the paddles are driven to rotate with the transmission formed of the gears and output shaft.

Figure 4:
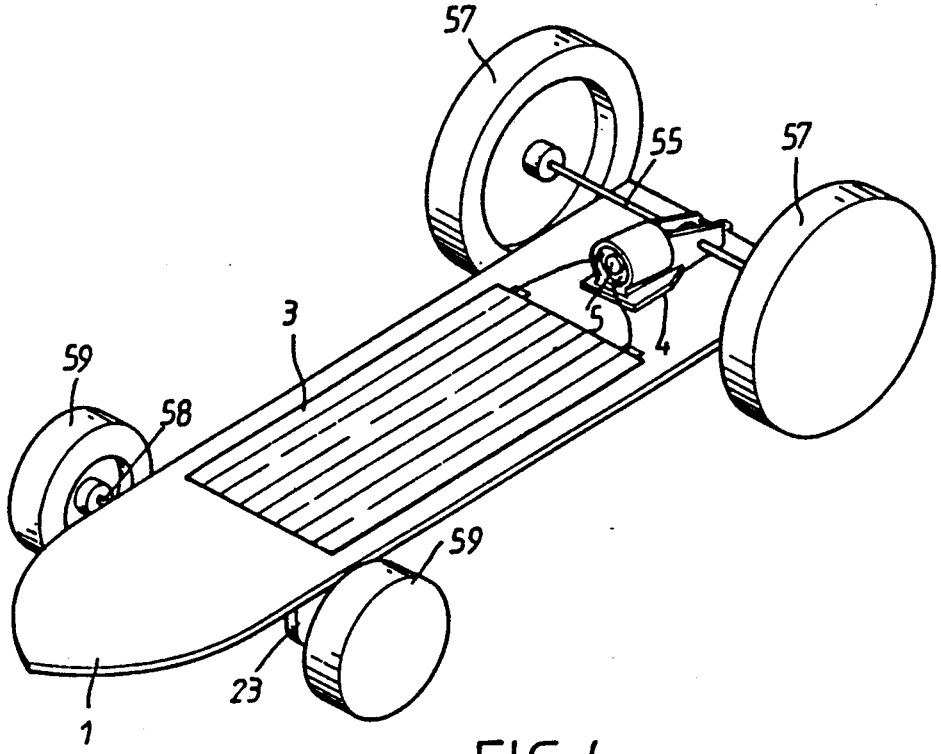
FIG. 4 is a perspective view of another embodiment according to the present invention.

The vehicle can be converted into a toy car as illustrated in FIG. 4, in which the plate 2 having the solar cells panel 3 and the motor 5 attached thereon is separated from the body 1, while the paddles 56 are replaced by a pair of rear wheels 57, and in addition, a front shaft 58 is inserted into through holes 25 to be mounted with a pair of front wheels 59. Similarly, as in operation, the solar energy provided by the solar cells panel can be utilized to drive the motor 5, whereas, with the help of the pinion gear and larger gear mounted on respective outputting shaft and transversally positioned driven shaft, the motor can force the vehicle to move. However, it is rather apparent that due to the front wheels and the rear wheels, the vehicle is able to move on the ground.

The housing 6, as illustrated in FIG. 2, is snapfitted to the base 4, and defines a space 61 to accommodate a rechargeable battery 62. It has a pair of side walls 63 extending downwardly to define a recieving portion 60 having a shape similar to that of the base 4 to facilitate the snapfitting action. Provided by the side walls 63 are recesses 64 to avoid interfering with the rotation of the driver shaft 55. A pair of conductive wires 65 extend from the housing 6 with terminals 66 connected to solar cells panel 3, so that solar energy generated by the panel can be charged into the battery 62. In addition, a diode 67 is electrically connected between the panel and the battery to ensure the current flow is only in one direction.

Further, according to the present invention, an aperture 27 is provided on the plate 2 of vehicle when it is used as a ship, onto which a fishing line is secured, so that it can be used either to limit the travelling distance thereof or to draw a fishing bait when the longer distance of fishing spot is desired and can not reached by manually casting, the later being popular in sea shore game fishing.

A multi-purpose solar energy operated toy vehicle according to the present invention is fully disclosed. As various changes or modifications could be made without departing from the spirit of the invention, it is intended that all matter contained in the above description shall be interpreted as illustrative and not in a limited sense.

What is claimed is:

1. A multi-purpose solar energy operated toy vehicle, comprising:

(a) a body, resembling a ship shape floatable on water;

(b) a plate secured on said body;

(c) a base, defining a bottom plate, a recess and a transmission box;

(d) a motor, snapfitting in said recess of said base, the motor having a pair of electric conductive terminals, an output shaft with a first gear mounted thereon extending into said transmission box;

(e) a driven shaft, transversely supported by said transmission box with a second gear fixedly attached thereon engaged with said first gear;

(f) paddle driving elements mounted on both ends of said driven shaft; and, (g) a solar cells panel capable of converting solar energy into electric energy by way of photoelectric effect secured to said plate, the panel having a pair of outputting wires with terminals electrically connected with said motor through said conductive wires thereof; so that said toy vehicle can be operated on water by the provision of solar energy which is converted into electric energy to drive said motor, so as to drive the driving elements through said first gear and said second gear incorporated with said output shaft and said driven shaft respectively.

2. A multi-purpose solar energy operated toy vehicle as recited in claim 1, wherein said body defines a plurality of apertures provided on the top surface thereof adapted to receive a plurality of short cylindrical projections integrally formed on said plate to receive said plate on said body.

3. A multi-purpose solar energy operated toy vehicle as recited in claim 1, wherein said body has longitudinal sides and defines a pair of recesses on both longitudinal sides of said body and further comprising a pair of wing plates extending integrally from said plate and adapted to snap-fit into said pair of recesses.

4. A multi-purpose solar energy operated toy vehicle as recited in claim 1, wherein the plate defines an aperture at a tail portion of said plate adapted to be engaged by a fishing line.

5. A multi-purpose solar energy toy vehicle as recited in claim 1, wherein said first gear and said second gear each comprise bevel gears.

6. A multi-purpose solar energy toy vehicle as recited in claim 3, further comprising through holes defined by said wing plates of said plate adapted to receive a front shaft for installing a pair of front wheels thereon.

7. A multi-purpose solar energy operated toy vehicle as recited in claim 1, further comprising; a battery; a housing defining a space to accommodate said battery; and a pair of conductive wires with terminals electrically connecting said battery with said solar cells panel for electrically charging said battery.

8. A multi-purpose solar energy operated toy vehicle as recited in claim 7, wherein said housing comprises a portion having a shape similar to that of said base so as to be in snapfitted engagement therewith, said housing defining recesses to avoid interfering with the rotation of said driven shaft.

9. A multi-purpose solar energy operated toy vehicle as recited in claim 7, further comprising a diode electrically connected with one of said pair of conductive wires to ensure that the electric current generated by said solar cells panel flows in one direction.

10. A multi-purpose solar energy operated toy vehicle as recited in claim 1 wherein said first gear comprises a pinion gear and said second gear comprises a ratchet gear.

* * * * *